United States Patent [19]

Okamoto et al.

[11] 4,390,572

[45] Jun. 28, 1983

[54] FUR-LIKE SYNTHETIC MATERIAL AND PROCESS OF MANUFACTURING THE SAME

[75] Inventors: Miyoshi Okamoto, Takatsuki; Syusuke Yoshida, Otsu; Nobuo Kurata, Shiga, all of Japan

[73] Assignee: Toray Industries, Inc., Tokyo, Japan

[21] Appl. No.: 288,818

[22] Filed: Jul. 31, 1981

[30] Foreign Application Priority Data

Aug. 4, 1980 [JP] Japan ..... 55-106407

[51] Int. Cl.[3] ..... A01N 1/00; B32B 3/02; B32B 33/00

[52] U.S. Cl. ..... 428/15; 428/92; 428/95; 428/96; 428/97; 428/903

[58] Field of Search ..... 428/92, 95, 96, 97, 428/373, 903, 369, 370, 17, 16, 15

[56] References Cited

U.S. PATENT DOCUMENTS 3,334,006 8/1967 Koller ..... 428/85

FOREIGN PATENT DOCUMENTS 1300268 12/1972 United Kingdom .

*Primary Examiner*—Marion McCamish
*Attorney, Agent, or Firm*—Austin R. Miller

[57] ABSTRACT

A fur-like synthetic sheet material is provided with numerous superfine synthetic pile fibers having fineness or thickness of about 0.0001 to 0.4 denier. The pile fibers, which are comparatively long, have crimps and are formed into bundle groups, while the crimps of the pile fibers are substantially in phase within each bundle.

26 Claims, 23 Drawing Figures

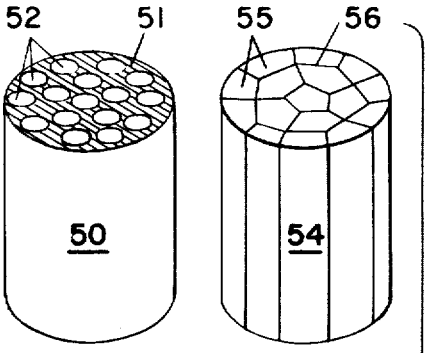
FIG. 1.
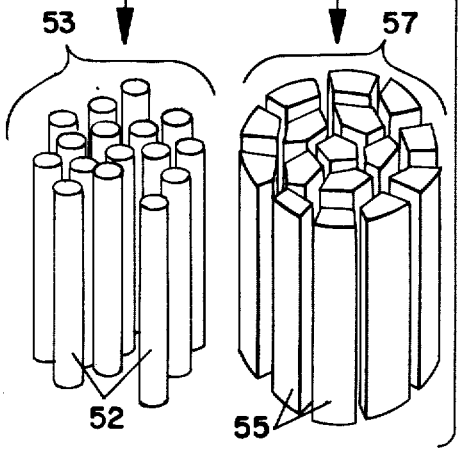
FIG. 2.
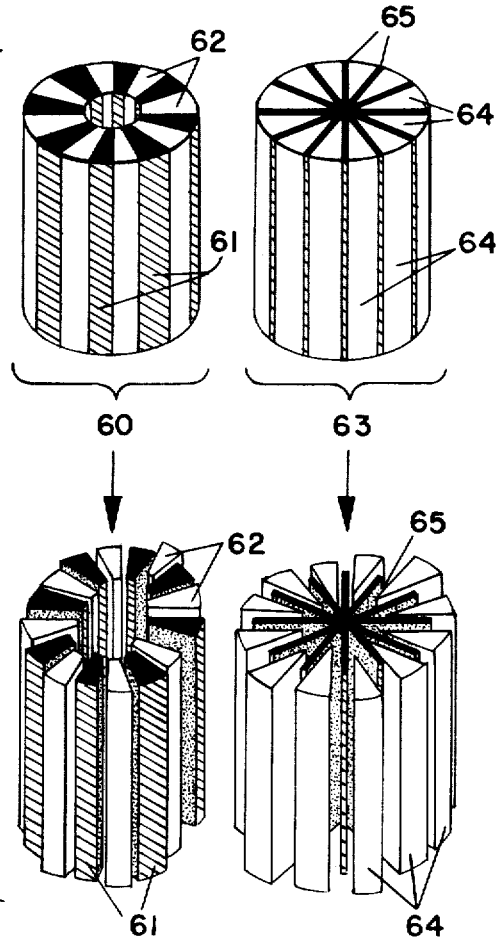

FUR-LIKE SYNTHETIC MATERIAL AND PROCESS OF MANUFACTURING THE SAME

BACKGROUND OF THE INVENTION

1. Field of the Invention

The present invention relates to a high grade fur-like synthetic material having superior hand feel, good appearance, voluminous touch and a silky luster. This invention further relates to a process of manufacturing a fur-like sheet material of superior quality and having overall characteristics surpassing in many ways even those of natural mink and chinchilla.

2. Description of the Prior Art

Many efforts have been made, for the purpose of providing synthetic furs of high grade, to imitate the structures and characteristics of high-grade natural furs. Although natural furs are commonly regarded as being composed of guard hair fibers and under-fur fibers, the tendency of prior efforts has been to direct primary attention to the guard hair fibers, and particularly to the fact that such fibers have thin and pointed tips, while being rather thick at middle portions thereof.

In some of the more advanced attempts particular notice has been taken of the fact that the root portions of the guard hair fibers are finer than the middle portions to a certain extent. It is very difficult, however, to produce fibers of the type described. While fiber products close to perfection have been proposed and worked on through extremely numerous trials, satisfactory results have not been obtained. Research has also been conducted on how to process these fibers into fabrics or into sheet-like forms, or how to process the same into fur-like forms by closely raising the fibers.

As far as the present inventors are aware, the resulting products are still far from high grade furs. They do not exhibit the superior appearance that is characteristic of fine furs, or the splendid and comfortable touch possessed by mink or chinchilla, and do not exhibit the highly desirable "air marks" or "air vibration" effects when subjected to the influence of streams of moving air. They have also been lacking as to feel. In general, and in summary, none is capable of satisfying the need which the present invention has now filled.

The "air mark" effect is a phenomenon that, when an air stream is directed against the pile fibers, as by blowing through the mouth, for example, traces of the air stream remain as deformations in the orientation of the fibers on the fur. Of course, such traces may be readily erased by smoothing down by hand.

The "air mark" phenomenon corresponds to the terms "chalk mark", "finger mark" or "writing effect" representing the phenomenon in which a trace formed by a finger tip behaves similarly and remains in such form that it can be observed.

The "air vibration" effect is a phenomenon whereby, when an air stream is directed against one point of the pile fibers the pile fibers spread in all directions and flutter or vibrate. The air mark effect and the air vibration effect are hardly noticeable upon testing conventional synthetic suede, velvet weaves commercially available, artificial furs, etc., although they are noticeable in natural chinchilla furs, natural nutria furs, etc.

Pile sheet materials having pile fibers composed of superfine fibers or filaments have heretofore been proposed by one of the present inventors, for example, in British Pat. No. 1,300,268. Excellent synthetic suede and other products can be made provided the fibers or filaments are short enough. However, upon actual production of pile sheet materials having pile fibers which are longer than four millimeters, in the manner disclosed in the British Patent, the product tends to acquire a rather squamous or scale-like appearance because of collection or gathering of bundles of pile fibers in use. Moreover, although the longer pile fibers have a puffy or warm feeling, the resulting product does not have a totally luxurious appearance, and does not provide the unique dim luster that is so desirable in furs. It is far short of being fully perfect for making synthetic-furs, even from the viewpoint of ease of raising the pile fibers.

U.S. Pat. No. 3,334,006 discloses a pile article having crimped pile fibers which are thicker than those of the present invention. The pile fibers are mutually bound by a binder and are thus divided into isolated groups. Each fiber in the group has a crimped or wavy configuration, but the crimps of the pile fibers are randomly disposed and are so adhered by the binder as to form a random network. Accordingly, it is extremely difficult to achieve a very soft hand feel, in spite of the comparatively easy raising of the pile fibers. Thus, it is not possible to achieve a truly fur-like fabric having superior characteristics and properties such as the heretofore mentioned "air mark" and "air vibration" effects, as well as other remarkable effects achieved by the present invention.

SUMMARY OF THE INVENTION

The present invention relates to a high quality fur-like material having superior touch and appearance and having a voluminous hand feel and a silky luster, along with many other outstanding properties.

It is a primary object of the present invention to provide a superior high grade fur-like pile fiber fabric having novel characteristics and properties.

It is another important object of the present invention to provide a high grade fur-like synthetic fabric of the above described type which is in the form of a cloth, fabric or the like having fur-like long pile fibers or fluff of high grade provided with a soft and extremely smooth and warm touch and a high grade appearance, with a very puffy fur-like swollen feel which is quite different from natural suede, and which has pile fibers which are simultaneously capable of lying down reversibly and having a luster effect and a three dimensional feel imparting a peculiar, unique and highly desirable appearance, and which further has such characteristics as the "chalk mark" effect, the "air mark" effect and the "air vibration" effect, heretofore described.

It is a further object of the present invention to provide a high grade fur-like synthetic sheet material of the above described type in which the drawbacks of sheets having particularly long fibers have been overcome. Another important object is to provide a fur-like artificial sheet material having a still more fluffy and warmer hand feel than those of the prior art, and having pile fibers which are more readily raisable, and are substantially free of conspicuous scale-like groups of pile fiber bundles, so as to present a high quality appearance on the whole.

In accomplishing these and other objects, according to preferred embodiments of the present invention, the fur-like synthetic sheet material comprises a base sheet and numerous superfine synthetic pile fibers or filaments formed thereon, said filaments having a fineness in the range between about 0.0001 denier and about 0.4 denier. The pile fibers having lengths in the range of about 4 to about 30 mm above the surface of the base sheet are crimped or curled to present a wavy configuration, and are present as bundle-like groups, each group having a thickness in the range of about 200 to about 2 denier, the crimps or waves of the pile fibers being substantially in phase with each other within each group. The expression "substantially in phase" is intended to mean that the crimps of the individual superfine synthetic pile fibers or filaments which form the groups are generally substantially aligned between crests or between valleys within the groups. The pile fibers are free of adhesion to each other, and are not fixed to each other by any binder.

A typical process of manufacturing the fur-like synthetic sheet comprises the steps of:

(1) preparing a primary pile sheet including a base sheet and primary pile fibers, the primary pile being composed of precursors for superfine fibers or filaments, arranged in groups, each group being composed of a mixture of at least two different precursors having different behavior upon contraction, particularly having a difference of percentage shrinkage of more than 5% as between them. The lengths of the pile fibers are preferably in the range of about 4 to 30 mm, and the precursors include a more easily softenable component and a less easily softenable component, the more easily softenable component having a softening point which is lower than that of the less easily softenable component, and said more easily softenable component being exposed at the surfaces of the precursors, (2) subjecting said primary pile sheet to heat treatment for softening the more easily softenable component having said lower softening point and causing crimps, waves or curls to be produced in the groups of said precursors selectively after fusing together said precursors at least within said groups, or simultaneously with said fusing together thereof, and (3) subsequently treating said precursors to generate superfine fibers or filaments by a superfining treatment which separates the fused fibers or filaments to provide independently arranged superfine fibers or filaments.

The detailed description of the invention which follows will be made with reference to certain specific forms of the invention illustrated in the drawings, which are intended to be illustrative but not to define or to limit the scope of the invention.

BRIEF DESCRIPTION OF THE DRAWINGS

FIG. 1 is a diagrammatic showing of a typical example of a precursor of the "islands-in-a-sea" type to generate superfine fibers or filaments, showing how individual superfine fibers or filaments may be made therefrom in accordance with one aspect of the present invention.

FIG. 2 is a diagrammatic showing similar to FIG. 1, showing other example of a precursor of a separable-type composite fibers or filaments, showing how individual superfine fibers or filaments may be created by mechanical separation in accordance with another aspect of the present invention.

DETAILED DESCRIPTION

Figure 3:
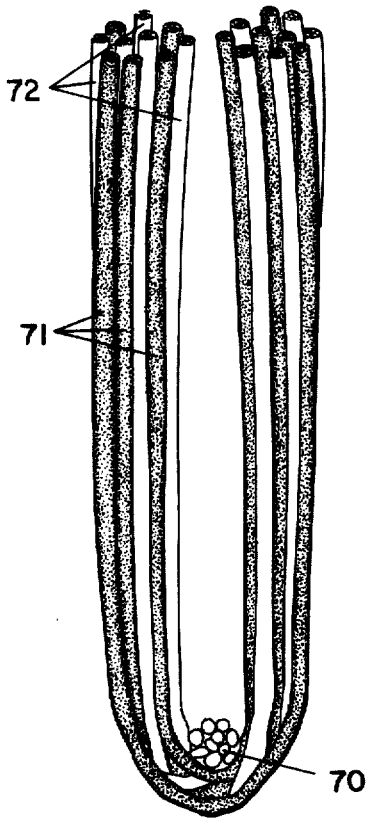
FIG. 3 is a diagrammatic showing of a portion of a fabric, greatly enlarged, at one stage of a typical primary stage in a process of manufacture in accordance with this invention.

Fur-like synthetic sheets according to the present invention have favorable touch and highgrade feeling as in mink, chinchilla, etc. which rank among the highest grades of natural furs, and simultaneously exhibit valuable characteristics and properties which are lacking even in natural mink and chinchilla.

Hereinbelow, the present invention will be described in more detail with respect to preferred embodiments.

Referring to FIG. 1 of the drawings, the upper left-hand fiber or filament 50 is a precursor of superfine fibers or filaments which are ultimately present in the fur-like product of this invention. The precursor 50 is a composite fiber or filament and has a sea component 51 with a multiplicity of island components 52. The vertical arrow diagrammatically indicates the step of removal of the sea component, which removal results in a bundle 53 of the island components 52, such island components being separable from one another and being capable of independent movement.

Similarly, the composite fiber or filament 54 is another form of precursor and includes a multiplicity of islands 55 separated by a very thin sea component 56. As indicated by the vertical arrow at the right in FIG. 1, removal of destructions of the sea component 56 results in a bundle 57 of individual island components 55, again independently movable with respect to each other.

The mechanism of removing the sea component from a composite fiber or filament is useful as one step in accordance with the process of this invention, as will further become apparent in detail hereinafter.

Turning to FIG. 2 of the drawings, another form of precursor is a separable type composite fiber 60 which comprises a multiplicity of superfine fibers or filaments 61, 62. Separation as by mechanical rubbing or the like separates the superfine fibers or filaments 61, 62, forming a multiplicity of individual superfine fibers or filaments 61, 62 as shown in the lower left-hand portion of FIG. 2.

Turning to the right-hand portion of FIG. 2, another precursor in the form of a separable type composite fiber 63 is composed of a multiplicity of superfine fibers 64 and 65. Again, separation by mechanical treatment produces a multiplicity of superfine fibers or filament 64 and 65 arranged in a bundle.

The mechanism illustrated in FIG. 2 of the drawings comprises an alternative to the removal of the sea component as illustrated in FIG. 1; both such methods are highly useful in accordance with this invention, as will appear in further detail hereinafter.

FIG. 3 of the drawings shows a yarn 70 which is one of many yarns contained in a fabric base or the like, together with a multiplicity of groups forming a pile. The groups are composed of precursors such as 50, 54, 60 or 63 of FIG. 1 or 2, for example. A plurality of these precursors, arbitrarily designated 71 in FIG. 3, have shrinkages of a predetermined magnitude, while others of composite fibers or filaments 72 have different shrinkages than the composite fibers or filaments 71.

Figure 19:
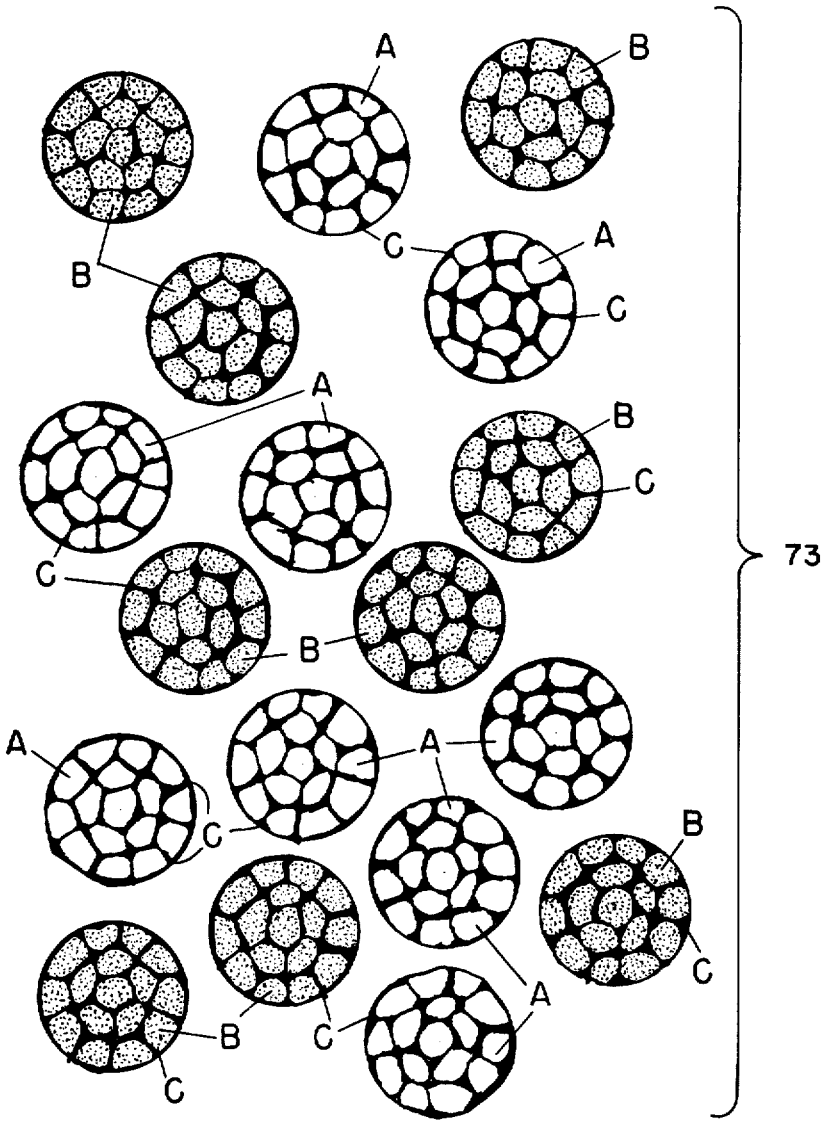
FIG. 19 represents a plurality of cross sectional views showing various examples of mixtures of superfine fibers or filaments which may be used in the practice of this invention.

Preferably, a group contain randomly arranged composite fibers or filaments 71 which are shown in FIG. 19 as being composed of polymeric superfine fibers or filaments A and a sea component C, and composite fibers or filaments 72 shown in FIG. 19 as comprising polymeric component B and sea component C.

It will be observed, in any event, that the composite fibers or filaments 71 and 72 are comprised of a multiplicity of superfine fibers or filaments, either as "islands-in-a-sea" type composite fibers such as 50 or 54 in FIG. 1, or as separable type composite type fibers such as 60 and 63 in FIG. 2. The elements 71, 72 are grouped in the form of a primary pile around the yarn 70 of the base fabric.

Figure 4:
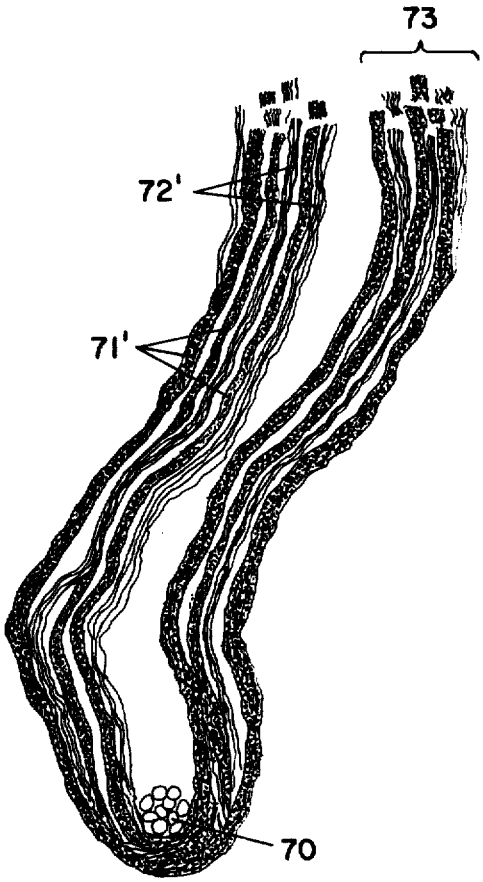
FIG. 4 is a view similar to FIG. 3, illustrating a later stage.

In the terminology utilized in this specification and in the claims, each unit 71 or 72 is referred to herein as a "precursor" for superfine fibers or filaments while the entire group of a multiplicity of precursors 71 and 72 is referred to as a "group" such as 73 in FIGS. 4 and 19.

Referring to FIG. 4 of the drawings, one form of product in accordance with this invention is diagrammatically shown. At this stage each of the precursors 71, 72 has been "microfined" by breaking down or removing the sea components C and the released superfine fibers or filaments have been crimped as bundles into wave-like formation. The precursors 71, subsequently converted into wave-like formation, are referred to by the number 71' in FIG. 4, while the precursors 72 also having been converted to a crimped or wave-like formation are referred to in FIG. 4 of the drawings as 72'. As stated, each element 71' or 72' is referred to as a "bundle", whereas the entire collection of bundles is referred to as a "bundle group" such as 73.

Although a variety of procedures may be utilized for forming a product in accordance with this invention, it is convenient to form the fabric from the precursors, to separate the individual superfine fibers or filaments, and to also cause them to assume a crimped or wavy configuration as shown in FIG. 4. Since different precursors have different shrinkage characteristics the product is composed of a multiplicity of bundle groups, each group containing a multiplicity of bundles, which bundles are produced from the precursors having different degrees of shrinkage relative to each other.

The sheet constituting the fur-like synthetic sheet material according to the present invention may be of various types including raised woven fabrics, knitted items, non-woven fabrics, films, plastic sheets, etc. However, cloth, fabric or the like is preferably employed, preferably velvet weaves such as double velvet weaves, single pile double velvet weaves, plural pile double velvet weaves, weaves with both faces velvet, no wire velvet or the like, chinchilla weaves, chenille weaves, plush, tricot pile knitted fabrics or other warp knitted fabrics or non-woven fabrics in which fibers are raised in bundles by needle-punching and increasing the amount of fiber caught by the barbs of the needle-punching apparatus, with the use of a needle having large barbs. Among the above, the pile fabrics, particularly the velvet weaves, are most preferable. In cases including the various cut pile fabrics, electrostatically flocked items, tricot, needle punch, plush weave, etc., it is desirable in many cases to fix the root portions of the pile fibers to the base by elastic polymeric materials such as polyurethane, etc.

In the case of velvet weaves and the like, there is sometimes a tendency for the pile fibers to extend through the reverse face, or for the pile fibers to readily come off. In such case it is desirable to slightly fix the reverse surface by applying a resin or the like, or by bagging the pile sheets and subsequent dyeing them. It should be noted that the concept of fixing the roots of the pile fibers to the base is not intended to cause restriction between or among the individual pile fibers, but has for its main purpose to improve the adherence of the pile fibers to the base and to prevent them from coming off. Therefore, fixing by application of elastic polymeric material as described above should be limited only to the root portions of the pile fibers.

For at least the pile fiber portions of the sheet material as described above, superfine artificial fibers or filaments of about 0.0001 to 0.4 denier are employed. Fibers or filaments coarser than about 0.4 denier are not preferable, since the resultant product becomes rough to the touch, while if the fibers or filaments have a thickness less than about 0.0001 denier, raisability of the piles become inferior and it is not preferable in respect of voluminous hand feel.

Particularly, a denier in the range from about 0.06 to 0.25 is most preferable. If the fibers are finer than about 0.06 denier, dark shades are difficult to obtain or the color fastness thereof may be inferior, even if such dark shades are achieved. The trend as described above is particularly conspicuous in the polyester fibers or filaments which are considered to be particularly favorable in practicing the present invention. On the contrary, if the fibers are thinner than 0.25 denier within the above range, products which are more flexible and which are softer to the touch may be obtained.

In the present invention, the root portions form bundle groups such as groups 73 of FIG. 4, these groups 73 may comprise from about 2,000,000 to 5 ends, preferably about 5,000 to 90 ends of the superfine fibers or filaments. The bundle-like groups 73 are of about 200 to 2 denier, preferably about 150 to 30 denier.

Crimps or waves are further imparted to the fibers in the groups, as shown in FIG. 4, and are characterized in that the crimps of the individual superfine fibers of each group are substantially in registry or in phase with each other, with the waves of the individual superfine pile fibers within each bundle group 73 of FIG. 4 being generally or approximately in alignment with each other in the high portions (i.e. crests) or low portions (i.e. valleys) within said bundle group 73.

The provision of waves or crimps in registry or in phase with each other wherein the crimps of the individual superfine pile fibers are not randomly arranged along the axis of the pile is important. Owing to the arrangement in which the pile fibers form bundle groups each having a thickness of about 200 to 2 denier and more preferably, about 150 to 30 denier which is equivalent to the denier of a so-called ordinary multifilament, and with the crimps being arranged in substantial registry or substantially in phase within each bundle group, the resulting product exhibits a fine voluminous appearance together with a very soft feel or touch—a highly desirable combination.

If the crimps or waves of the individual pile fibers were not in substantial registry or substantially in phase within the respective bundle groups, the product containing the superfine fibers would not fully utilize the desirable effect of the crimps as compared to the use of fibers of ordinary type. Thus, the desired bulkiness and other properties of the product would not be achieved.

Furthermore, according to the present invention, since the crimps are imparted, deterioration in quality due to formation of squamous groups on the surfaces of the pile fibers is advantageously reduced. Because of the nature and arrangement of the crimps according to the present invention, squamous groups are not readily noticeable in spite of the fact that the pile fibers are in the form of the bundle groups (grouped multifilament bundles). Thus, a higher grade fur-like product has been created, with a marked improvement of appearance, while the product has a greatly enhanced voluminous feel or touch, a warmer feeling and more ease of raising the fibers.

In the present invention each group of pile fibers comprises a plurality of bundles of superfine fibers or filaments further collected or gathered into a bundle-like group configuration, generally equivalent in size to one normal end of yarn composed of multi-filaments or spun yarns.

The method of manufacturing the superfine fibers of the present invention is not particularly limited. However the bundles of superfine fibers or filaments may be formed by removing the sea constituent from an "islands-in-a-sea" type composite fiber or filament as in FIG. 1, or by mechanically separating the superfine fibers from a sea component as in FIG. 2. The resulting aggregation of superfine fibers is referred to herein as a "bundle" of superfine fibers. These are subsequently gathered and assembled into a group as, for example, earlier described with reference to FIGS. 3 and 4. Such a group is referred to herein as a "bundle group". It is large enough to be observed with the naked eye.

The term "islands-in-a-sea" type composite fiber or filament referred to above denotes a composite fiber or filament composed of a plurality of superfine filamentary constituents (island constituents) in a matrix of a different constituent (sea constituent). Typical constructions thereof are disclosed, for example, in British Pat. No. 1,300,268 assigned to the assignee hereof.

For manufacturing the superfine fibers or filaments themselves constituting these pile fibers, it is preferable to employ, for example, a process which produces a precursor, which means fibers or filaments that can be broken down to produce the finer fibers or filaments therefrom through subsequent processing. A specific example without implying any particular limitations, comprises removal of a sea constituent from "islands-in-a-sea" type composite fibers or filaments, or "islands-in-a-sea" type polymer blended spun fibers or filaments. This term also includes separable type composite fibers or filaments as disclosed, for example, in British Pat. Nos. 1,171,843 and 1,300,268 and in U.S. Pat. Nos. 4,109,038, 4,051,287, 4,037,988 or 4,165,556. In short, the materials or structures need only be those in which crimps can be imparted to the superfine fibers or filaments themselves, by some means.

The superfine precursors include multi-composition fibers or filaments composed of a more difficultly softenable component which is capable of being formed into a plurality of superfine fibers and filaments, having a fineness in the range of about 0.0001 to about 0.4 denier, and another component having a softening point which is lower, and which is exposed at the surface. The difference of softening points should preferably be more than about 30° C.

Such softening point as described above may be measured as disclosed under "Testing Method for Softening Point of Thermoplastics", in JIS K7206-1974. The percentage exposure of the lower softening point component to the surface of the fibers or filaments should be greater than about 50%, preferably greater than albout 80%. In this respect the "islands-in-a-sea" type composite fibers or filaments are particularly preferable, since the lower softening point components, as in 51 or 56 in FIG. 1, can be specifically positioned in a configuration to cover the entire surface of the fiber or filament, as in 52 or 55 in FIG. 1, for example.

The following are specific examples of materials for the superfine fibers or filaments of the precursor: polyethylene terephthalate or copolymers thereof (e.g. copolymer compositions such as isophthalate, 5-sodium-sulfoisophthalate, etc.) polybutylene terephthalate or copolymers thereof, (e.g. copolymer compositions such as isophthalate, 5-sodium-sulfo isophthalate, polybutylene oxide, etc.) nylon 66, nylon 6, nylon 11, nylon 12, polyacrylonitrile polymers, or copolymers thereof, regenerated cellulose, etc. On the other hand, the lower softening point component may be any material having a lower softening point and is capable of being separated from other component. Specific examples include polystyrene, polystyrene copolymers, polyethylene, polyolefin copolymers, polyester copolymers, polyamide copolymers, etc.

According to the present invention, at least two kinds of precursors are mixed for use, having shrinkage percentages differing from each other by more than 5% in boiling water at 100° C.

Figure 5:
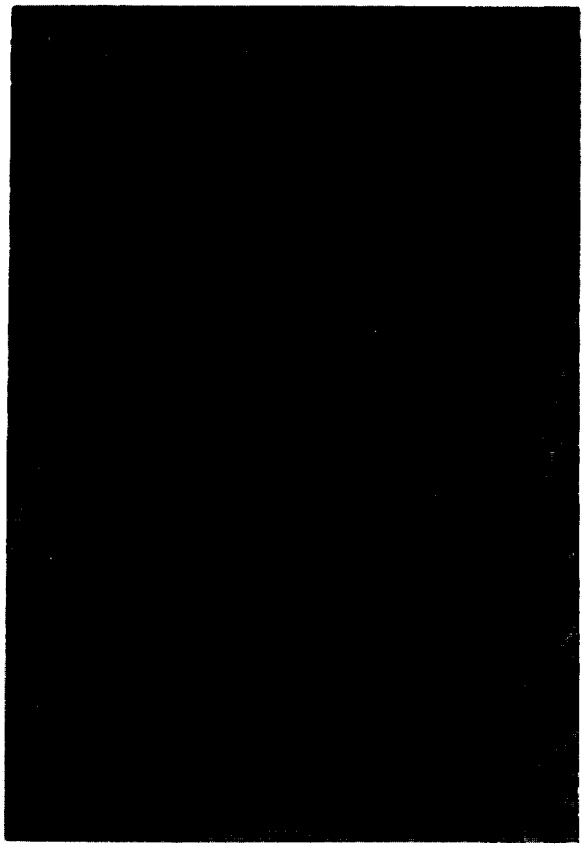
FIG. 5 is a photograph at 20 magnifications, sectionally through the base, of a fur-like sheet material comprising one embodiment of the present invention.

In FIG. 5 of the drawings, which comprises a photograph of a typical product according to this invention, it is apparent that the pile fibers are formed into bundle groups, with crimps generally aligned or in registry within the bundle groups. The thickness of the bundle group of pile fibers and the number of superfine fibers constituting each bundle may be as heretofore described.

It is to be noted that the fibers of each bundle, and the bundle groups as well, are not held together by a binder or the like, and thus, individual superfine fibers within each bundle, and the bundles in the group are free, without substantial bonding therebetween. Although the reason for the importance of formation of such bundle groups is not entirely clear, this is considered to be related to the product characteristic that fiber settling is comparatively good, since the superfine fibers or filaments are present as groups. The superfine fibers or filaments have a tendency to remain together and not be readily separated. All superfine fibers or filaments in the group are easily bent all together and are not separated individually even if the bending force falls on the sheet of the invention in use of it. This is considered to be due to the small amount of rigidity that is inherent in the superfine fibers or filaments, and also to the fact that the superfine fibers or filaments have an inherent tendency to remain bundled together despite the substantial absence of binder.

The pile fibers are required to have lengths in the region of about 4 to 30 mm. Lengths shorter than about 4 mm are not preferable, since many beneficial effects according to the present invention, including the air mark effects, the air vibration effect and others are diminished. Thus, the fiber lengths should most preferably be in the range of about 6 to 20 mm, and preferably in the vicinity of about 10 mm. On the contrary, if the lengths are greater than about 30 mm, the resulting product tends to be excessively heavy or the pile fibers are likely to tangle, causing difficulties in weaving, knitting or formation into sheets.

For the materials constituting the pile fibers, any artificial fibers that can be formed into superfine fibers may be employed. Examples of such materials are polyethylene terephthalate or copolymers thereof (for example, copolymer compositions such as isophthalate, 5-sodium-sulfo-isophthalate, etc), polybutylene terephthalate or copolymers thereof (for example, copolymer compositions such as isophthalate, 5-sodium-sulfo-isophthalate, polybutyleneoxide, etc.), nylon 66, nylon 6, nylon 11, nylon 12, polyacrylonitrile polymers or copolymer thereof, regenerated cellulose, etc. In connection with the above, individual groups of the pile fibers are constituted by a mixture of superfine fibers or filaments being produced from the precursors having different shrinkage characteristics. In the ordinary practice, the mixture of more than two kinds of superfine fibers or filaments being produced from the precursors having shrinkage percentages different from each other by more than 5% may be employed. The shrinkage percentage referred to above is based on the value as obtained in boiling water at 100° C. For differentiating the shrinkage percentages as described above, it is desirable to constitute the groups of the pile fibers as a mixture of superfine fibers or filaments composed of different kinds of polymers, or a mixture of superfine fibers or filaments composed of homopolymers and those composed of copolymers thereof, or a mixture of superfine fibers or filaments having different rates of copolymerization when both of the superfine fibers or filaments are composed of copolymers, or a mixture of superfine fibers or filaments having different draw ratios. It is one of the extremely special features of the present invention that the pile fibers, although composed of a mixture of different kinds of fibers or filaments, have the crimps thereof substantially in phase with each other, as between their crests or valleys, within the group of fiber bundles as shown, for example, in FIG. 16 of the drawings. It is preferable that the portions adjacent to the roots of the pile fibers be set in an inclined attitude approximately in one direction.

Similarly, in natural furs the raised hairs or fluffs thereof have a tendency to be inclined in a particular direction. In contrast to the natural furs, however, it is a special feature of the present invention that although the pile fibers are set so they are inclined in a single direction in the vicinity of the root portions, such pile fibers may be caused to fall or lie down in any direction as a result of manually stroking or smoothing the fibers down on the sheet.

In the case of natural fur it is difficult to cause the raised hairs of the fur to lie down in a direction opposite to the direction of inclination of the roots. Even if they are somehow caused to lie down in such a direction the appearance of the product is extremely poor. On the contrary, according to the present invention, it is now made possible to cause the pile fibers to lie down in any desired direction, while the natural appearance thereof is fully maintained, without presenting an extremely unnatural look. Thus, the drawbacks of the natural furs have been radically improved upon in this respect.

Figure 22:
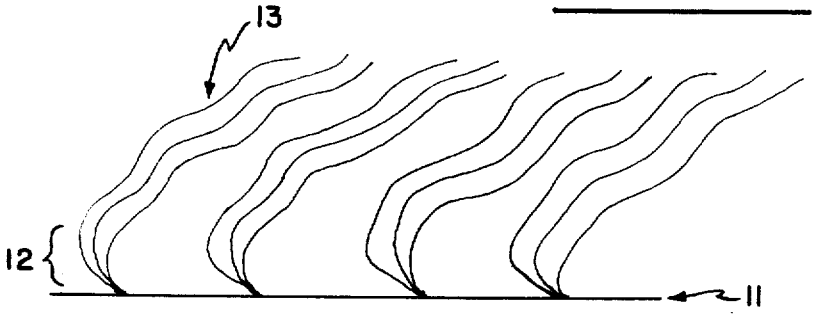
FIGS. 22 and 23 are sectional diagrams explanatory of the structure of fur-like sheet materials according to the present invention.
Figure 23:
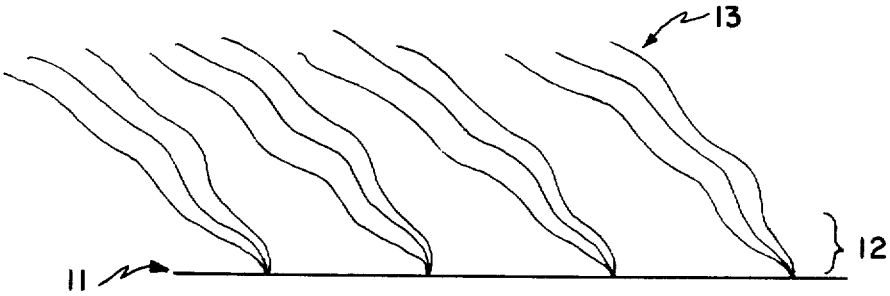

The points as described above are illustrated by simple model diagrams as shown in FIGS. 22 and 23, in which the base sheet portion is represented by the numeral 11, the pile fibers by the numeral 13, and portions in the vicinity of the roots of the pile fibers by the numeral 12.

More specifically, FIG. 22, shows, in schematic form, a sectional view with the pile fibers smoothed down in the direction opposite (reverse direction) to the set direction in the vicinity of root portions thereof. FIG. 23 illustrates, similarly in a model form, a sectional view with the pile fibers smoothed down in the same direction (forward direction) as the set direction, in the neighborhood of the root portions.

According to the present invention, the fur-like material can be produced by preparing a primary pile sheet of precursors of superfine fibers such as the composite fibers or filaments 50, 54, 60, 63 of FIGS. 1 and 2.

If desired, a high polymeric elastic or resilient material may be applied to the root portions of the precursors containing the fibers. The fibers are treated to produce crimps in the pile fibers, and to liberate the superfine fibers or filaments from their precursors. Dyeing may be practiced with a flexing action, with simultaneous setting to impart directivity to the pile fibers, preferably a liquid flow dyeing machine. Desirably this is followed by further imparting an oily agent to the fibers for finishing, and by subsequent drying, etc.

The primary pile sheet is subjected to heat treatment for producing crimps in the pile fibers. Although the heating temperature may vary for different materials employed, it is normally preferable to select a temperature in the range from 80° to 200° C. Heating softens the lower melting point component and forms crimps and fuses together precursors. Since primary pile comprises the mixture of more than two kinds of precursors having shrinkage percentage different from each other and are fused together, the crimps generally aligned with the group are obtained. Subsequently, the bundle groups having crimps thus produced are subjected to a superfining treatment (or separation treatment) which forms pile fibers. One way of performing this "superfining" step is to dissolve out the sea constituent of an "islands-in-a-sea" type composite fiber. Another way, using separable and divisible type composite fibers or filaments, is to separate boundary faces of composite fibers or filaments by treatment with a swelling agent, or by heating or by use of mechanical stress, etc.

It is preferable to apply a high polymeric binder, such as polyurethane solution, polyurethane emulsion, polyvinyl alcohol etc., to the root portions to adhere them to the base, either before or after the superfining treatment, preferably before, since this enhances easy raising of the pile fibers. Dyeing treatment is also preferable, and dyeing by use of a liquid flow dyeing machine is particularly preferable, since the pile fibers gain directivity in the sense that they are set and inclined in one direction at the root portions thereof, with desirable flexing action.

Many fiber finishing oily agents or lubricants may be employed. Smoothing agents, antistatic agents or surface active agents known to those skilled in the art as finishing agents may be applied. By employing smoothing oily agents an extremely flexible and soft hand can be achieved. When drying the resulting fur-like sheet material, it is preferable to keep the pile fabrics inclined in one direction, at below 120° C., most desirably by air-drying at room temperature. The root portions of the pile fibers may be set slightly inclined in one direction.

It is possible to alter the order or sequence of the crimp treatment, superfining treatment, dyeing treatment and finishing treatment, and such alterations do not obstruct the achievement of the objects of the present invention.

The sizes of the squamous groups, if present, tend to become small and inconspicuous, thanks to the presence of the crimps. In the present invention, at least the portions in the vicinity of the tips of the pile fibers are free of bonding by the binder. Normally, in the portions of the pile fibers from the tips to the vicinity of the roots thereof, the superfine fibers or filaments are preferably not bound by the binder. Thus, the sheet of the present invention is radically different from those in which pile fibers are bound by such binder so as to positively form squamae or scales. In the fur-like synthetic sheet according to the present invention, the binder is only imparted, in some cases, to prevent the pile fibers from coming off at their root portions or within the base sheet, or to improve the feel.

The product has a remarkable surface appearance, particularly after stroking down somewhat strongly by hand. Stroking down in a forward direction and then in a reverse direction imparts a three-dimensional appearance and a high-grade feel. This effect is referred to herein as an anisotropic crimped pile fiber effect. The product also has highly desirable "air mark" and "air vibration" effects.

The product of the present invention also has a superior luster effect. When the pile fibers are repeatedly stroked down strongly 20 times in one direction by hand, the feel of the pile fibers is radically changed. Unexpectedly the luster of the surface (where the pile fibers are simultaneously laid down) comes out remarkably. This condition may be erased by stroking in the reverse direction by hand.

Although conventional products manufactured of artificial fibers have been regarded as lacking in warmth, the product of the present invention unexpectedly provides a luxuriously warm feel. Probably owing to the fact that the crimps are substantially uniform in the group, the product, although composed of the superfine fibers or filaments, provides resiliency warmth and pleasant elasticity to the hand when touched, and moreover has the tendency that the pile fibers can be manually raised quickly even after they have been caused to lie down.

Many of the outstanding characteristics of the product appear in the accompanying photographic drawings. FIGS. 6 through 10 are photographs showing the condition of the surface of a fur-like sheet having a pile fiber length of 10 mm as viewed from directly above. FIGS. 11 through 15 are photographs similar to FIGS. 6 through 10, but particularly show a fur-like artificial sheet having a pile fiber length of 15 mm.

The magnification of each photograph is one-to-one, and the direction of inclination by the setting at the roots of the pile fibers is indicated by the thin arrow, and is regarded as the forward direction herein. (Hereinbelow, the directions are referred to with respect to said forward direction). In normal length products, the direction is indicated as the longitudinal direction.

Figure 6:
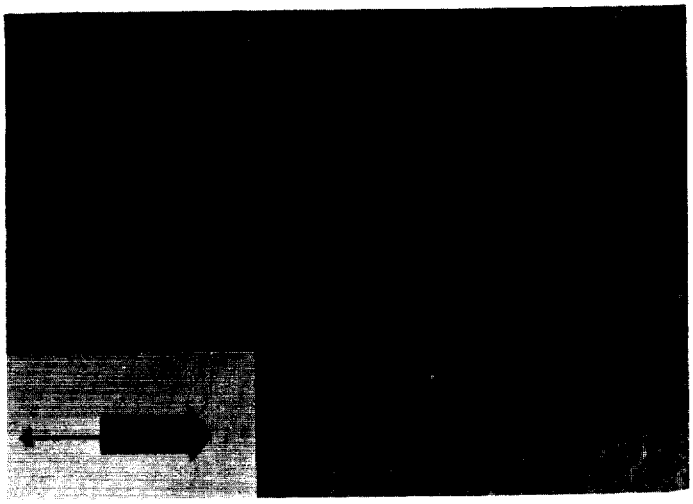
FIGS. 6 to 15 are surface photographs showing variations of various pile fibers according to one preferred embodiment of the present invention.
Figure 11:
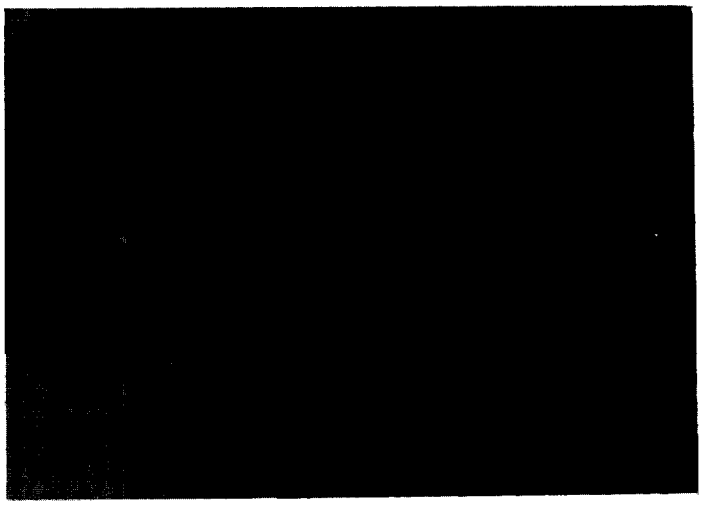

FIGS. 6 and 11 show the effect in which the squamous appearance of the material is made less conspicuous, and the anisotropic crimped pile fiber effect, after the product has been stroked down once in the reverse direction (i.e. in the direction of the thick arrows).

Figure 7:
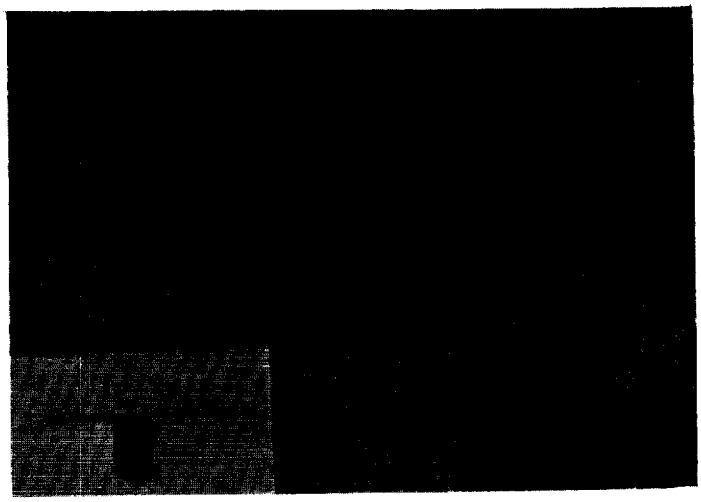
Figure 8:
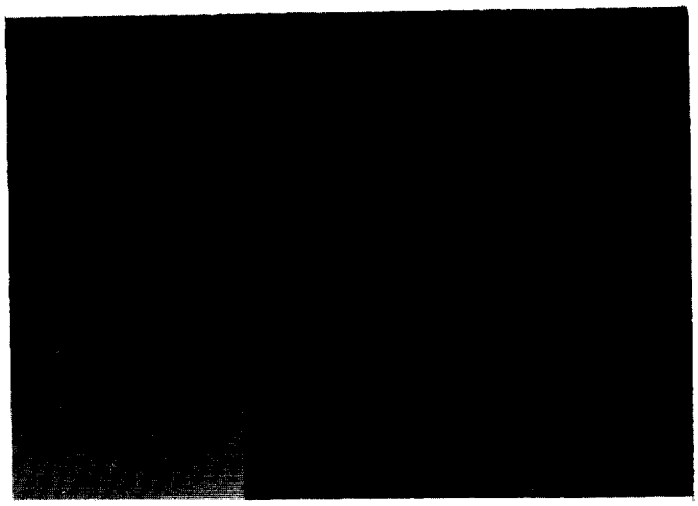
Figure 12:
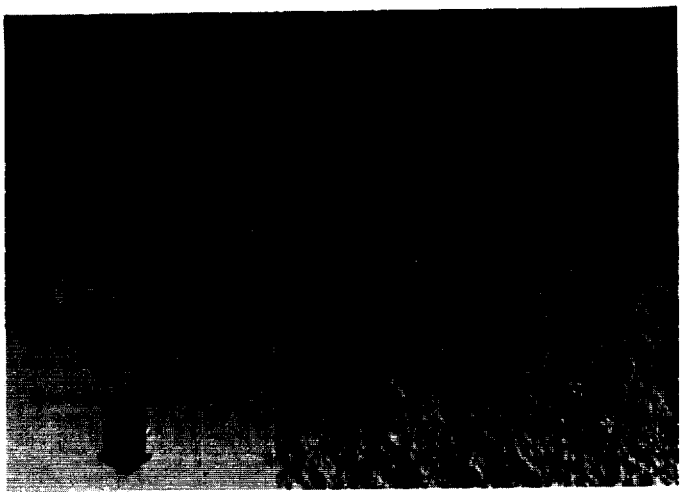
Figure 13:
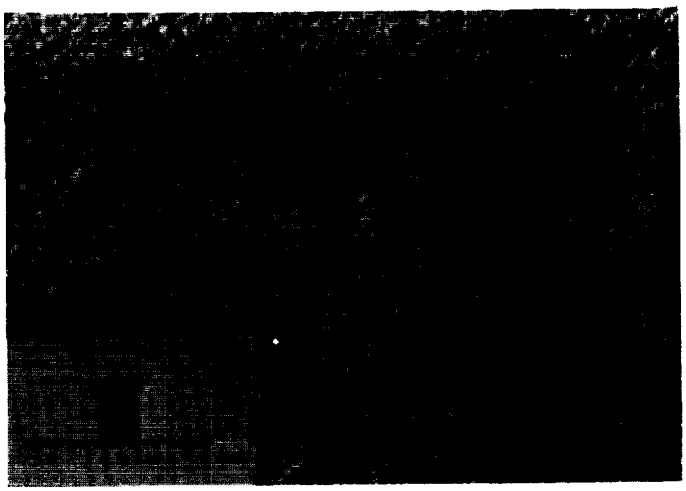

FIGS. 7 and 12 show the effect when the product has been stroked down once in the left-hand direction, while FIGS. 8 and 13 illustrate the effect after the product has been stroked down once in the right-hand direction.

Figure 9:
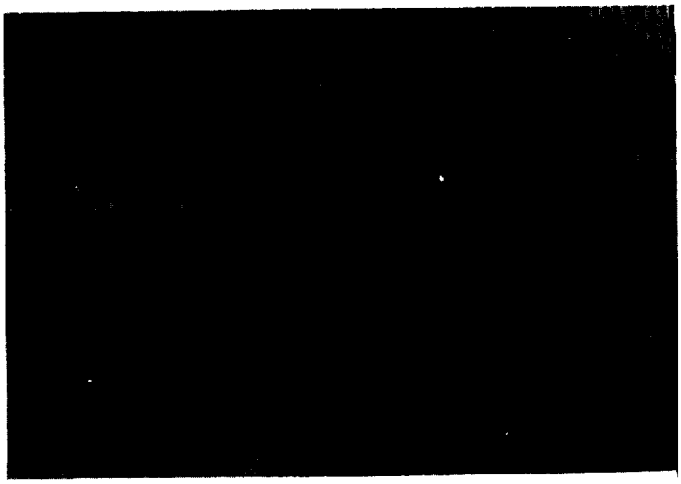
Figure 14:
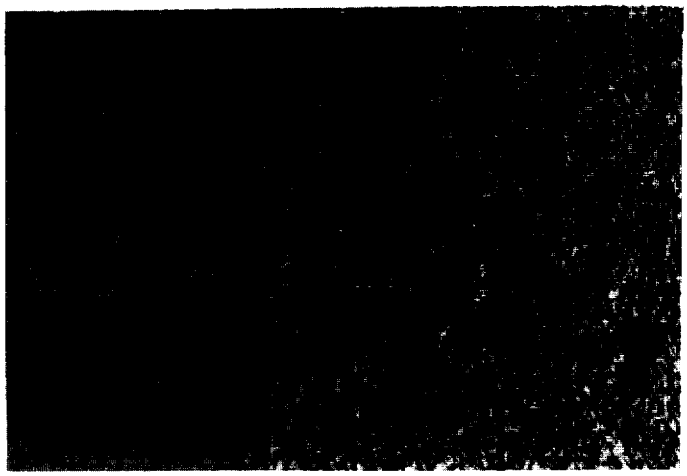

FIGS. 9 and 14 show the effect when the product has been stroked down once in the forward direction.

Figure 10:
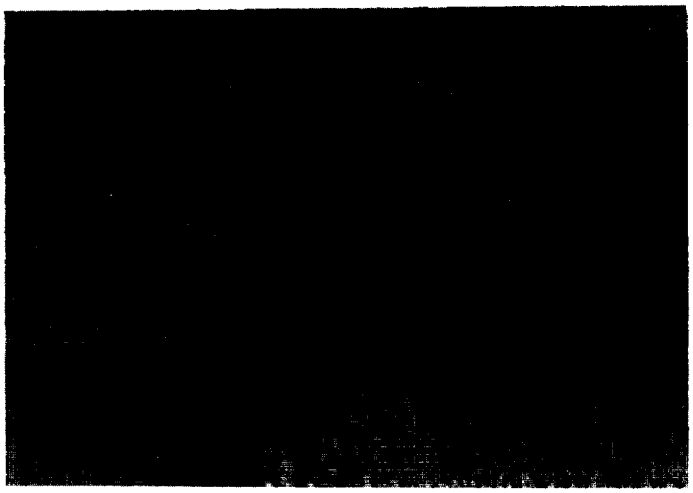
Figure 15:
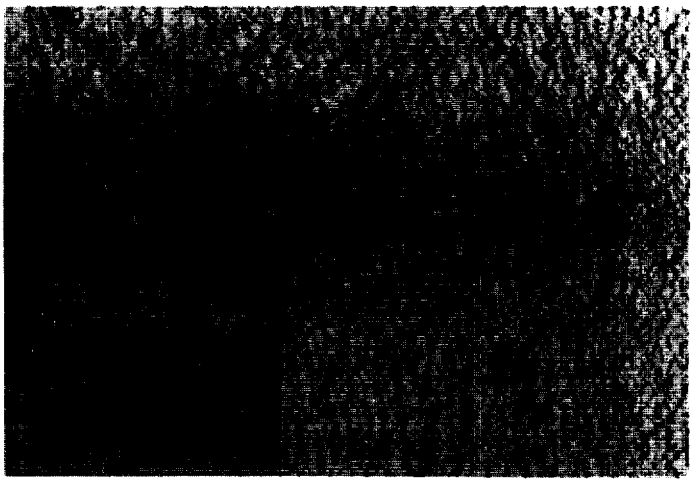

FIGS. 10 and 15 illustrate the remarkable specular gloss or luster obtained after stroking down 20 times in the forward direction.

Figure 16:
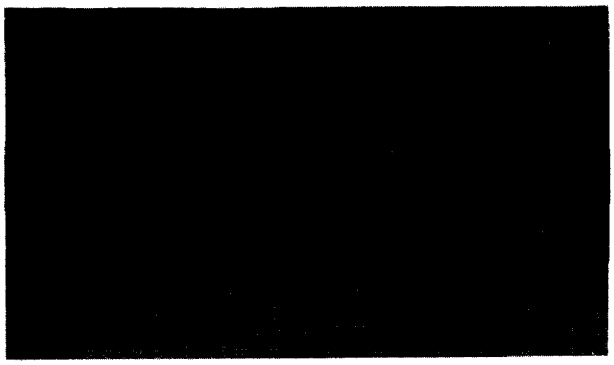
FIG. 16 is a microscopic photographic view of one example of pile fibers with crimps as observed from one side thereof.
Figure 17:
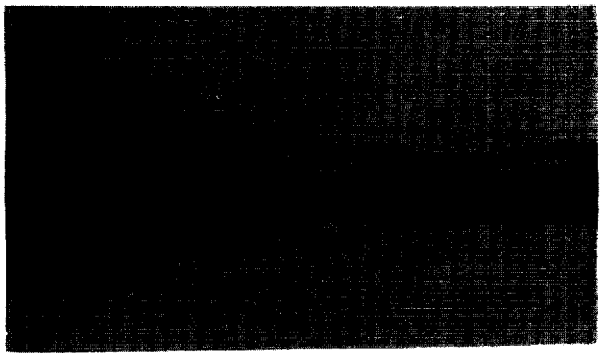
FIG. 17 is a view similar to FIG. 16, but particularly showing a non-crimped sample of pile fibers.

FIGS. 16 and 17 are microscopic photographs of pile fibers which were pulled out of the fabric. FIG. 16 shows a preferred embodiment of the present invention, and clearly shows the crimps arranged in registry, or in phase, in the bundle group. The same condition may be confirmed even in FIG. 5.

FIG. 17 is a comparative example and indicates a fabric otherwise similar to FIG. 16 but wherein the filaments are not crimped, or in which the crimps are not clearly observable. This represents pile fibers formed by employing fibers or filaments in which the shrinkage difference between two kinds of superfine fibers or filaments is not significant.

Figure 18:
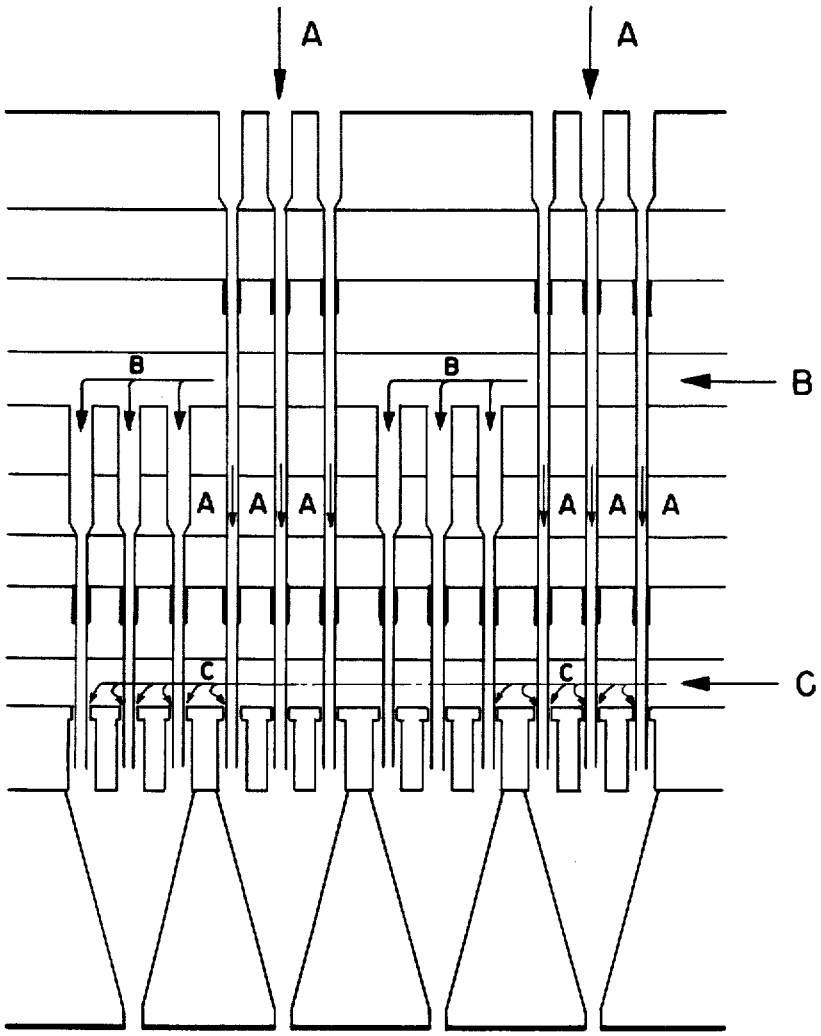
FIG. 18 is a cross sectional view showing one example of a spinneret for spinning a mixture of two kinds of superfine fibers simultaneously and under favorable fiber mixing conditions.

FIG. 18 is a diagram simplified for better understanding and showing the cross section of a typical exemplary spinneret for producing fibers employed in the present invention. In FIG. 18, three compositions are introduced through the portions marked with the arrows A, B and C. Two kinds of "islands-in-a-sea" type composite fibers or filaments i.e. one type of fiber or filament having island constituent "A" in sea constituent "C", and the other type of fiber or filament having island constituent "B" in sea constituent "C" are simultaneously spun. All portions other than the polymer introducing portion are constructed by piling up numerous spinneret plates. It is to be noted that, in FIG. 18, hatching has been intentionally omitted in order to avoid complication.

The spinneret of FIG. 18 is set in a three-component conjugate spinning machine for spinning.

FIG. 19 illustrates cross sections of mixtures of the two kinds of "islands-in-a-sea" type composite fibers or filaments spun by the use of such spinnerets as in FIG. 18. The symbols A, B and C denote the same compositions as previously referred to in connection with FIG. 18. With the composition C provided as a common component, the superfine fibers having the A composition and those having the B composition are spun in an appropriate mixture. The fibers or filaments as described not only provide length differences of each superfine fiber or filament owing to the difference of shrinkage percentages, but form, to our surprise, crimped fiber bundles as shown in FIG. 16.

In the embodiment selected for FIG. 16, one yarn was formed by employing 18 ends of "islands-in-a-sea" type fibers or filaments where each "islands-in-a-sea" type fiber or filament had 16 islands. Therefore the entire structure, after the sea constituent had been removed, formed the bundle group, and FIG. 16 shows the crimps that were produced therein.

Figure 20:
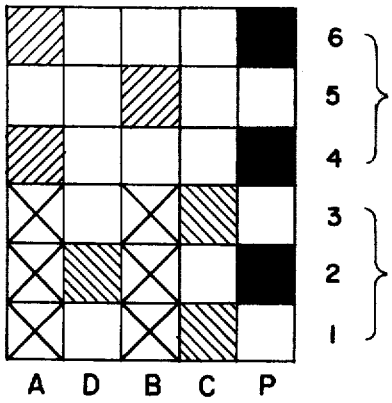
FIG. 20 is a structural diagram showing one example of a velvet weave according to one preferred embodiment of the present invention.
Figure 21:
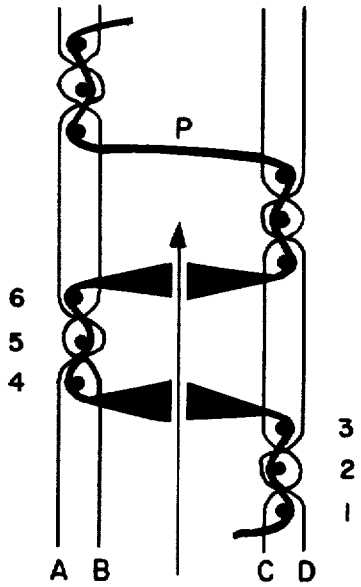
FIG. 21 is a sectional view explanatory of the weave structure of FIG. 20 for better understanding thereof.

FIG. 20 is a structural diagram of a fabric according to one embodiment of the present invention, in which numerals 1, 2 and 3 mean the weft of the reverse side, the numerals 4, 5 and 6 denote the weft of the front side, while the symbols A, B, C, D and P are given for correspondence to FIG. 21 (P indicates "pile").

FIG. 21 is a schematic cross sectional diagram showing the construction of the fabric. The symbols A and B show the front side and C and D indicate the reverse side. The numerals 1, 2 and 3 in FIG. 20 correspond to the numerals 1, 2 and 3 in FIG. 21, while the numerals 4, 5 and 6 also correspond in a similar manner. The symbol P indicates "pile", and the arrow designates cutting by a knife.

Hereinbelow, selected examples are provided for the purpose of illustrating the present invention, without any intention of limiting the scope thereof, which is defined in the appended claims.

EXAMPLES 1 and 2

Yarns A were used for the warp as pile yarns, yarns B for the warp as ground yarns, and yarns C for the weft as ground yarns. Four different fabrics in total were made. Two primary pile fabrics had pile lengths of 10 mm (Example 1) and two other primary pile fabrics had pile lengths of 15 mm (Example 2). All were prepared in double velvet weaves. The weave density for A was 47 pieces/inch, for B was 94 pieces/inch, and for C was 146 pieces/inch.

Yarn A was made by the following procedure.

With the use of a 3-component conjugate spinning machine (including a spinneret) capable of simultaneously spinning two different "islands-in-a-sea" type composite fibers or filaments, the following "islands-in-a-sea" type composite filaments were spun (at 900 m/min) and drawn (at 3.1 times, and 350 m/min with a 90° C. hot roll):

Island component X=
- polyethylene terephthalate (softening point 239° C.) (16 islands)

Sea component (common)=
- polystyrene copolymer; (softening point 56° C.): copolymerization with 2-ethylhexyl acrylate at 22 wt.%

Island component Y=
- polyethylene terephthalate copolymer; (softening point 218° C.): copolymerization with 10 mol % of isophthalic acid (16 islands)

The composite filaments (island 80%, island denier 0.2 denier, sea 20%) for the island component X were of 36.5 denier-9 filaments, and had a shrinkage percentage of 15.3% in 100° C. boiling water, while the composite filaments (island 80%, island denier 0.2 denier, sea 20%) for the island component Y were of 36.5 denier-9 filaments, with a shrinkage percentage of 25.5% in 100° C. boiling water. Therefore a mixture of these filaments, which was 73 denier and 18 filaments, in total, was prepared as yarn A.

Yarn B was prepared as follows: (there is one case where yarns B1 were employed and another case where yarns B2 were employed).

The yarns B1 were a polyester filament which is dyeable with a cationic dye in 50 denier-18 filaments. The yarns B2 were false twisted yarns; 50 denier-24 filaments and were obtained by subjecting TORAY TETORON BRERIA (trade name of Toray Industries, Inc.,) to twisting at 400 T/M and setting for twist stabilization at 95° C. for 20 minutes, with subsequent sizing in a Warpersizing machine.

Yarns C were produced as follows: (in one case yarns C1 were employed and in another case yarns C2 were employed)

The yarns C1 were the same as the yarns B1, and the yarns C2 were the same as the yarns B2, except that the sizing was omitted.

When the yarns B1 were employed as the warp, the yarns C1 were used for the weft. When the yarns B2 were employed as the warp, the yarns C2 were adopted as the weft. These four different fabrics were passed through a pintenter drying machine at 140° C. and then were passed through the pintenter drying machine at 180° C. Thus, crimps were produced. Subsequently, the fabrics were placed in hot water at 95° to 98° C. for relax desizing and then dried. The hot water contained 2 grams/liter of Sandet G-29 (Cleaning agent made by Sanyo Kasei Co., Ltd.) and 2 grams/liter of soda ash.

These four different fabrics were passed through a Vibrowasher machine and treated with trichloroethylene for removing the sea component (they were passed through nine times, with fresh liquid introduced every three times). They were then squeezed. The resulting fabrics were subjected to drying in a hot air drying machine at 100° C. The fabrics thus processed had waves or crimps in the pile fibers, and had a considerably voluminous appearance. The pile fibers had been laid down in one direction due to the squeezing operation. However, upon stroking by hand in the opposite direction, the pile fibers were easily raised in the form of lines at irregular intervals as in a washboard, thus showing an appearance entirely different from that in the gray fabric.

The fabrics processed in the above described manner were tested on a pressure type liquid flow dyeing machine (referred to as a "circular" machine) for dyeing at 120° C. for 60 minutes. The fabrics made of yarns A, B1 and C1 were dyed into a light greenish blue shade with a cationic dye. The fabrics of yarns A, B2 and C2 were dyed into a light brownish gray with the use of a disperse dye.

The resulting fabrics were further subjected to reduction cleaning by using hydrosulphite and caustic soda and then washed by passing hot water therethrough. The hot water contained an antistatic agent, a smoothing agent "Silstat #1173" made by Sanyo Kasei Co., Ltd. and "Babinar S783" also made by Sanyo Kasei Co., Ltd. The fabrics thus processed were subjected to air-drying after dyeing.

The resulting products each had an extremely smooth hand, and an excellent touch like that of natural chinchilla or mink furs. Especially in the products having pile fiber lengths of 10 mm, the groups of the pile fiber bundles were each of about 60 denier and favorably raised, having a light, puffy or swollen feeling (See FIG. 5). As shown in FIGS. 5 and 16 the pile fibers had crimps, and had a dim and warm luster owing to the crimps and the superfine denier. Furthermore, the products possessed a highly desirable swollen and puffy feeling, like those of high-grade furs, and entirely different from suede or the like. Moreover, being composed of synthetic fibers, the products of the present invention were free from unpleasant odors as compared to natural furs, and were further capable of being readily and repeatedly washed. In the tests as described above, the products of a single width did not differ in dimensions from one sheet to another, as in natural furs.

Further advantages of the fur-like products according to this example included the fact that the pile fibers could lie down in any direction, and also in an almost reversible manner. (As compared with products without crimps the pile fibers were comparatively favorably raised, and erected in a considerably dispersed or scattered manner). The products lacked the undesirable squamous appearance, owing to crimp formation. Upon pushing the pile fibers aside, groups of pile fibers were observed in the form of yarns or threads, each group being of about 60 denier. The anistropic crimped pile fiber effect was also observed. Furthermore, the "air mark" and "air vibration" effects were also noticeable. Additionally, the luster effect as shown in FIGS. 10 and 15 were further observed. Such luster effects could be erased, if desired. The fur-like product was warm upon handling, and gave a warm and pleasant feel to the hand when touched.

EXAMPLE 3

With the use of the pile primary fiber fabrics before removing sea component by trichloroethylene in Examples 1 and 2, a coating of polyurethane resin was applied to the fabrics from their reverse surfaces. In one case, 10% by weight of a polyurethane resin solution in dimethylformamide was used. The polyurethane was produced by employing methylene-bis-aniline as a chain extender and 75 parts of polyether and 25 parts of polyester as a soft segment. The PU adhesion factor was 9.7 $g/m^2$. In another case, 37% by weight of polyether polyurethane emulsion was applied for coating. The PU adhesion factor in this case was 7.5 $g/m^2$.

Subsequently, similar manner to Examples 1 and 2, the sea constituent was removed by trichloroethylene, and similar treatments followed. In any of these samples, the touch on the surface was the same as in Examples 1 and 2, while the raising of the pile fibers was favorable, with soft repellency having a desirable degree of stiffness, and also with a further improved warm feeling.

Upon comparison it has been found that the raised hairs of natural mink and chinchilla are thicker than the fibers employed in the present invention, and of finer denier than the fibers in general. Even more surprising, they had crimps in a similar manner to the present invention. However, in the hairs of the mink and chinchilla, the crests or peaks of the crimps were independent, with the vicinity of the pores being narrowed for protrusion in the form of bundles, while scales are present in the hairs in a similar manner as in the guard hairs. It has been found that the fur-like synthetic sheet according to the present invention has superior properties which are believed to justify its being referred to as an ultrafur, because of the advantages that it is composed of still finer fibers or filaments and can be dyed into any desired colors, with capability of being dyed only at portions close to the tips if desired. Further, it is proof to moths and can be washed in conventional washing machines. Furthermore, it may be produced in various lengths and at a specified width, does not exhibit shrinkage or hardening by hot water, and is free from unpleasant animal or tanning odors.

The superior fur-like material according to the present invention has many useful applications and end uses, for example, for clothing such as coats, shawls, mufflers, long overgarments, hats and caps, etc., interior decoration articles such as covering for chairs, wall coverings, carpets, furniture, bedding, etc., and shoes, bags, pouches, wiping cloths and the like.

While the present invention has been described fully and in detail by way of examples and with reference to the attached drawings, it should be noted that various modifications and variations will be apparent to those skilled in the art. Therefore, unless otherwise such variations and modifications depart from the scope of the present invention, they should be construed as included therein.

We claim:

1. A fur-like synthetic material which comprises a base and a multiplicity of superfine synthetic pile fibers formed thereon, said fibers having a fineness in the range between about 0.0001–0.4 denier, said pile fibers having lengths in the range of about 4 to 30 mm, said fibers being crimped and further being formed into bundle groups, said bundle groups having thicknesses in the range of about 200 to 2 denier as measured at the root portion thereof, said crimps of said pile fibers being substantially in phase with each other within each group, and said superfine pile fibers being substantially free of any binders as between themselves.

2. A fur-like synthetic material as claimed in claim 1, wherein the fineness of said superfine pile fibers or filaments is in the range of about 0.06 to 0.25 denier.

3. A fur-like synthetic material as claimed in claim 1, wherein the length of said pile fibers is in the range of about 6 to 20 mm.

4. A fur-like synthetic material as claimed in claim 1, wherein each of said groups of pile fibers has a thickness in the range of about 150 to 30 denier as measured at the root portion thereof.

5. A fur-like synthetic material as claimed in claim 1, wherein each of said groups of pile fibers is composed of superfine synthetic fibers or filaments of about 2,000,000 to 5 ends in number.

6. A fur-like synthetic material as claimed in claim 1, wherein each of said groups of pile bundles of fibers is composed of superfine synthetic fibers or filaments of about 5,000 to 90 ends in number.

7. A fur-like synthetic material as claimed in claim 1, wherein each of said groups of bundles of pile fibers is composed of a mixture of bundles of superfine synthetic fibers or filaments having been subjected to shrinking treatment, said bundles having different shrinkage percentages before shrinking treatment.

8. A fur-like synthetic material as claimed in claim 1, wherein each of said groups of bundles of pile fibers is composed of a mixture of bundles of superfine synthetic fibers or filaments having been subjected to shrinking treatment, said bundles having shrinkage percentages differing by more than about 5% before shrinking treatment.

9. A fur-like synthetic material as claimed in claim 8, wherein each of said groups of bundles of pile fibers is composed of a mixture of bundles of superfine synthetic fibers or filaments, said bundles comprising different kinds of polymers.

10. A fur-like synthetic material as claimed in claim 8, wherein each of said groups of bundles of the pile fibers is composed of a mixture of bundles of superfine synthetic fibers or filaments substantially consisting of homo-polymers and superfine synthetic fibers composed of a copolymer thereof.

11. A fur-like synthetic material as claimed in claim 8, wherein each of said groups of bundles of the pile fibers is composed of a mixture of bundles of polymeric superfine fibers or filaments having different draw ratios.

12. A fur-like synthetic material as claimed in claim 8, wherein each of said groups of bundles of pile fibers is composed of a mixture of different bundles of polyethylene terephthalate superfine synthetic fibers or filaments and superfine synthetic fibers or filaments of copolymers thereof.

13. A fur-like synthetic material as claimed in claim 1, wherein said superfine synthetic fibers or filaments are of polyester fibers or polyamide fibers.

14. A fur-like synthetic material as claimed in claim 1, wherein said superfine synthetic fibers or filaments are of at least one kind selected from the group consisting of polyethylene terephthalate fibers, polyethylene terephthalate copolymer fibers, polybutylene terephthalate fibers, polybutylene terephthalate copolymer fibers, nylon 6 fibers, nylon 66 fibers, nylon 11 fibers, and nylon 12 fibers.

15. A fur-like synthetic material as claimed in claim 1, wherein said material is in the form of a fabric, cloth or the like having superfine synthetic pile fibers.

16. A fur-like synthetic material as claimed in claim 1, wherein said material is a woven fabric having superfine synthetic pile fibers.

17. A fur-like synthetic material as claimed in claim 1, wherein said material is a cut pile fabric.

18. A fur-like synthetic material as claimed in claim 1, wherein said material is a velvet weave.

19. A fur-like synthetic material as claimed in claim 1, wherein said pile fibers lengths are at least about ten times the thickness at the root portion of each of said groups of bundles of pile fibers.

20. A fur-like synthetic material as claimed in claim 1, wherein said pile fibers are fixed by a binder only at the root portions thereof.

21. A fur-like synthetic material as claimed in claim 1, wherein a smoothing finishing oily agent is imparted to the surface of the material.

22. A fur-like synthetic material as claimed in claim 1, wherein said pile fibers are set in an inclined attitude approximately in one direction in the vicinity of the root portions thereof.

23. A process of manufacturing a fur-like synthetic material which comprises the steps of:

(1) preparing a primary pile sheet including a base and primary pile fibers, said primary pile being composed of a group of precursors for superfine fibers or filaments, each said group being composed of a mixture of at least two different precursors, said precursors having a difference in shrinkage percentage of more than 5% therebetween, the lengths of the primary pile fibers being in the range of about 4 to 30 mm, each said precursor including one component forming a plurality of superfine fibers or filaments having a fineness in the range of about 0.0001 to 0.4 denier and the other component having a softening point lower than that of said one component, and said other component being exposed at the surface of the precursor, (2) subjecting said primary pile sheet to heat treatment for softening said other component having said lower softening point and causing crimps to be formed in said group of said precursors selectively after fusing together at least some of said precursors at least within said group, or simultaneously with said fusing together thereof, and (3) subsequently unbinding said precursors to generate superfine fibers or filaments.

24. A process as claimed in claim 23, wherein said group of precursors for superfine fibers or filaments is composed of about 1,000 to 2 ends of precursors.

25. A process as claimed in claim 23, wherein said precursors are "islands-in-a-sea" type fibers or filaments.

26. A process as claimed in claim 23, wherein said group of precursors comprise a mixture of "islands-in-a-sea" type fibers or filaments composed of an island component of polyester homo-polymer and a sea component consist of at least one member selected from the group consisting of polystyrene, polystyrene copolymer and polyethylene, and another "islands-in-a-sea" type fiber or filament composed of an island component of polyester copolymer and a sea component consisting of at least one member selected from the group consisting of polystyrene, polystyrene copolymer and polyethylene.

* * * * *